United States Patent [19]

Müller

[11] Patent Number: 4,579,154

[45] Date of Patent: Apr. 1, 1986

[54] SACKING CONNECTION FOR FILLING OPEN-TOP SACKS WITH DUSTY PRODUCTS

[75] Inventor: Mathias Müller, Viersen, Fed. Rep. of Germany

[73] Assignee: Haver & Boecker, Oelde, Fed. Rep. of Germany

[21] Appl. No.: 589,189

[22] Filed: Mar. 13, 1984

[30] Foreign Application Priority Data

Mar. 17, 1983 [DE] Fed. Rep. of Germany ..... 3309531

[51] Int. Cl.[4] ..... B65B 43/30

[52] U.S. Cl. ..... 141/59; 141/75; 141/93; 141/114; 53/570

[58] Field of Search ..... 141/10, 67, 68, 114, 141/313–317, 89–93, 37–66, 69–80, 129–191; 53/255, 570, 573, 260, 261, 262

[56] References Cited

U.S. PATENT DOCUMENTS 3,851,444 12/1974 Merat ..... 141/89

4,174,599 11/1979 Callet et al. ..... 141/93

4,305,252 12/1981 Barathé et al. ..... 141/59

*Primary Examiner*—Houston S. Bell, Jr.

*Attorney, Agent, or Firm*—Sprung, Horn, Kramer & Woods

[57] ABSTRACT

A sacking connection for filling sacks that are open at the top with dusty products has two spreading flaps that can be pivoted around horizontal axes. Clamping jaws can be pivoted around horizontal axes and hold the edge of the opening of the sack against the spreading flaps. The front of the spreading flaps are connected by dustproof aprons made of a flexible material and fastened in the vicinity of the side edges of the flaps. When folding-sided sacks are filled, a folding device that can be displaced along with its functions of folding from outside the sacking connection into the space inside the sacking connection is associated with each apron. When flat sacks are filled, a spreading device that can be displaced outward from inside along with its functions of spreading is associated with each apron. The functions of folding or of spreading connect the edge of the sack opening with the aprons to prevent dust from building up on the inside of the edge of the opening of the sack.

14 Claims, 12 Drawing Figures

SACKING CONNECTION FOR FILLING OPEN-TOP SACKS WITH DUSTY PRODUCTS

BACKGROUND OF THE INVENTION

The present invention relates to a sacking connection for filling open-top sacks with dusty products, with two spreading flaps that can be pivoted around horizontal axes and with which are associated clamping jaws that can be pivoted around horizontal axes and hold the edge of the opening of the sack against the spreading flaps.

A sacking connection of this type is known from German Patent No. 1 948 229.

There are several problems involved in filling open-top sacks with dusty products. Aside from the effects on the environment that such products can have, especially if they are chemicals, there is a risk that the edge of the sack cannot be sealed reliably enough or only by expensive means because of dust buildup in the vicinity of the closure seam. The dust problem can lead, when plastic sacks are being sealed, for example, to the necessity of cleaning the inside surface of the closure-seam zone manually or mechanically, which can, however, depending on the type of dust and its chemical composition, still not be effective enough in many cases for the sack to be reliably sealed with a closure seam.

When the inside of the vicinity of the closure seam gets contaminated, it could result in a welded seam of a quality too poor to seal the sack. It may for example be necessary to clean the inner surface of the sack in the vicinity of welded seam that is to be applied, which entails additional expense.

The only alternatives, consequently, are to seal the sacks with a separately applied rider tape or to utilize valve sacks instead of open sacks. Both possibilities are, however, uneconomical because additional equipment is needed to apply the rider tape and because valve sacks are essentially more expensive to manufacture than open sacks.

Along with the need to solve the dust problem, however, there is that of achieving a loading efficiency equal to that of comparable but non-dusty products.

Further, the closure-seam area of sacks with folding sides cannot be mechanically cleaned. If the sides are not unfolded during the filling process the loading efficiency will be correspondingly low.

SUMMARY OF THE INVENTION

The object of the present invention is a sacking connection of the aforesaid type in which the applied and clamped edge of a folding-sided or flat sack being filled is effectively protected to the fullest extent at the inside surface of the closure-seam area against the penetration of dust while the sack is being filled and sealed.

This object is attained in accordance with the invention in that the front of the spreading flaps are connected by dustproof aprons made of a flexible material and fastened in the vicinity of the side edges of the flaps and, in the case of sacks with folding-sides, a folding device that can be displaced along with its means of folding from outside the sacking connection into the space inside the sacking connection is associated with each apron and, in the case of flat sacks, a spreading device that can be displaced outward from inside along with its means of spreading is associated with each apron and the means of folding or of spreading non-positively connect the edges of the sack opening with the aprons.

In one embodiment of the invention the spreading flaps are plates and bent sheets of metal are fastened in alignment with the plates to their vertical lateral edges and can be removed from them, and the plates and bent sheets are as wide as the sacks.

To obtain an unobjectionable seal between the bent sheet fastened thereto in the vicinity of the connecting seam, the apron overlaps the sheet in the vicinity of the connecting seam in the shape of a U. The apron can be provided with perforations for screwing flanges on the bent sheet.

At the outside of the bent sheet the apron merges with a strip of rubber or plastic that extends over the lower horizontal edge of the plate and against which the edge of the opening of the sack can be held with a clamping jaw.

The edge of the opening of the sack applied to and clamped against the sacking connection thus rests against the aforesaid strips on the plates and against the aprons that connect the plates at the front, specifically both during the filling process when the sacking connection is open and upon completion of the filling process when the sacking connection is closed.

The applied position of the edge of the opening of the sack in the vicinity of the lateral aprons is secured, depending on whether the sacks are folding-side or flat, by folding devices or spreading devices, preventing dust from building up on the inside surface of the edge of the sack opening while allowing the total opening to be exploited for filling.

When packaging dust-laden products in plastic sacks that are open at the top, it has been found that sacking connections according to the invention must accordingly be designed so that the edge of the opening of the sack will rest at all points against the outside of the spreading flaps and of the aprons on the front. When the spreading flaps are closed, every apron assumes the form of a tube or sacks with folding sides. The edge of the opening of a flat sack that is to be filled assumes the form of a convex lens when the spreading flaps are open. Each apron must accordingly be brought into a position that corresponds to the shape of the edge of the opening of the sack while the spreading flaps are opening.

Therefore, another object of the present invention is to improve the sacking connection, to include a spreading device that acts from the inside toward the outside on the aprons secured at the front against the spreading flaps which is of a simple design that does not prevent the edge of the opening of the sack from being applied to the sacking connection and reliably protects the inside surfaces of the vicinity of the closure seam from the effects of dust while the sack is being filled.

This object is attained in accordance with the invention in that the spreading device consists of two spreading fingers that project into the sack with their lower ends, that are positioned in the vertical midplane of the sacking connection, that are mounted in such a way that they can rotate around horizontal axes, and that can be pivoted outwardly out of the vicinity of the spreading flaps and clamping jaws with a concomitant elastic deformation of the aprons until the aprons rest non-positively against the edge of the opening of the sack.

The design of the spreading device as fingers that can be pivoted around a horizontal axis makes it possible to easily slide the interior parts of each apron, which form a side fold, out over the side edges of the spreading flaps so that the outer wall of each apron will rest tightly against the inside of the edge of the opening of the sack. At least the area where the welded seam is to be applied in a subsequent operation is accordingly effectively protected against the penetration of dust.

In one preferred embodiment, the folding finger, which rests against the apron on the outside, and the spreading finger, which rests against the apron on the inside, are mounted in such a way that they can rotate around a common horizontal axis so that the motion of both the folding finger and the spreading finger can be powered by a common drive mechanism. A special advantage in this case is that the axis is embodied in a driven shaft on which is clamped a holder to which the upper ends of the spreading and folding fingers are attached. This constitutes an especially simple design because one spreading and one folding finger is mounted in one holder.

The dust generated during filling will not get into the environment of a sacking connection equipped with a central filling tube or with filling aprons when the connection has an upper framework-like cover through which the filling tube or similar structure extends, with suctioning tubes positioned at one side of the filling tube or similar structure and suctioning the dust from above out of a filling opening that is sealed on all sides.

Preferred embodiments of the invention will now be described with reference to the attached drawings, wherein:

DETAILED DESCRIPTION OF THE PREFERRED EMBODIMENT

Figure 1:
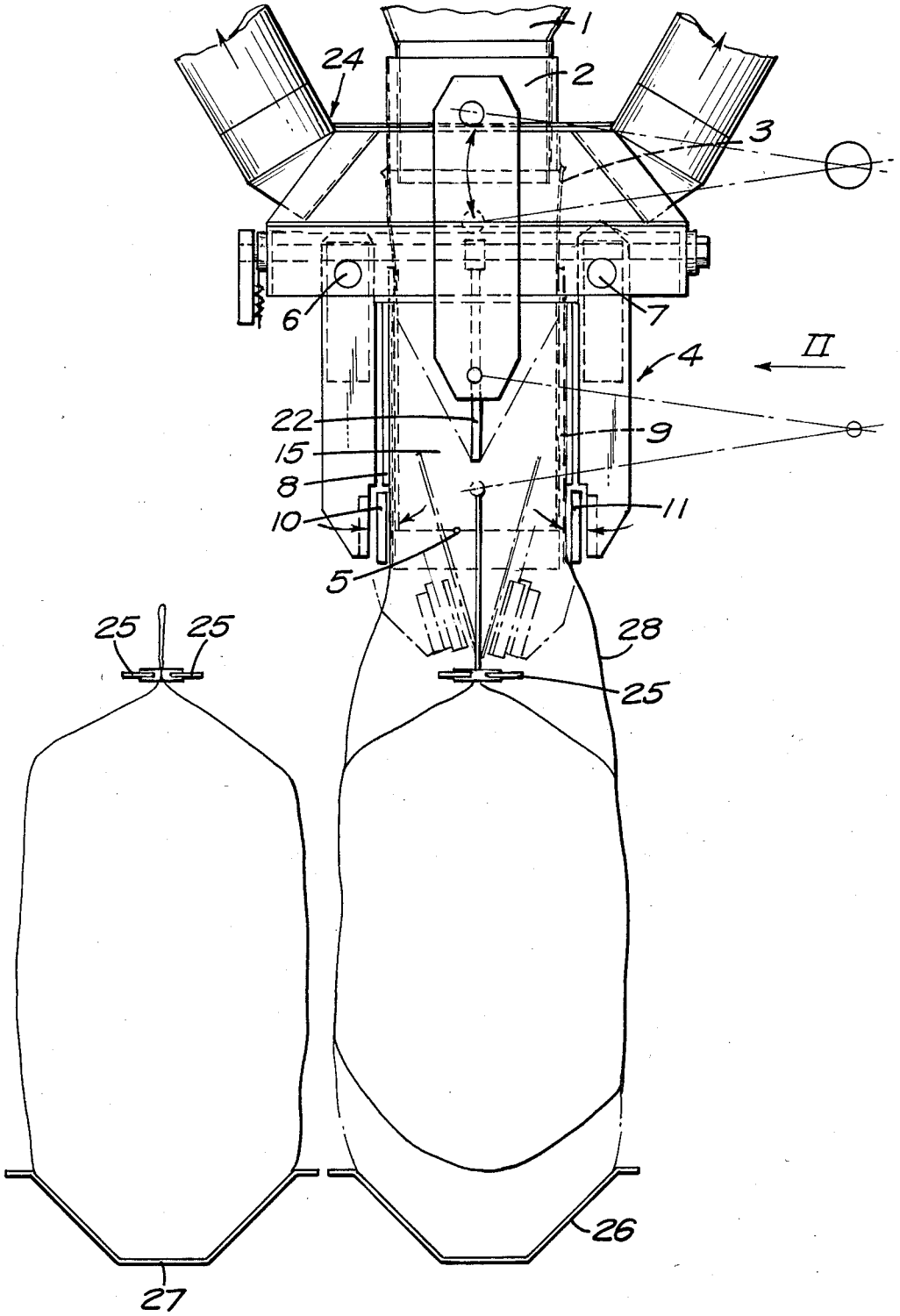
FIG. 1 is a front elevation of the sacking connection with a sack applied in the opening and in the closure position and with an associated removal belt.

Referring to FIG. 1–5, a pouring funnel 1 has an outlet connection 2 to the bottom edge of which is attached a flexible loading hose 3 made out of rubber or a rubber-like plastic and extending inside a sacking connection 4 to the extent that its bottom edge 5 is below the edge of the opening of a sack 28 clamped to the sacking connection 4.

Sacking connection 4 has two spreading flaps 8, 9 that can be pivoted around horizontal axes 6, 7 and with which are associated clamping jaws 10, 11, which can also be pivoted around horizontal axes 6, 7.

The spreading flaps 8, 9 are plates with bent sheets 12 fastened to their vertical lateral edges. Each plate and each sheet fastened to it is as wide as the sack.

In this embodiment bent sheets 12 are provided with screwing flanges 13 that are secured to spreading flaps 8, 9 with screws 14.

To obtain unobjectionable dustproofing in the vicinity of the connecting seam between bent sheets 12 and spreading flaps 8 and 9 the edge parts of an apron 15 made out of rubber or a rubber-like plastic overlap two mutually opposed bent sheets 12 in the vicinity of the connecting seam in the shape of a U. The apron is provided with perforations for the screwing flanges 13 of bent sheets 12 in the vicinity of the connecting seam.

Aprons 15 constitute the front sides of sacking connection 4.

Spreading flaps 8 and 9 have strips 16 of rubber or plastic that extend over their bottom horizontal outer edge. The clamping jaws 10 and 11 associated with spreading flaps 8 and 9 have strips 17 of rubber or plastic so that the upper edge of the sack is clamped fast between strips 16 and 17 in the vicinity of the flaps and jaws.

Figure 5:
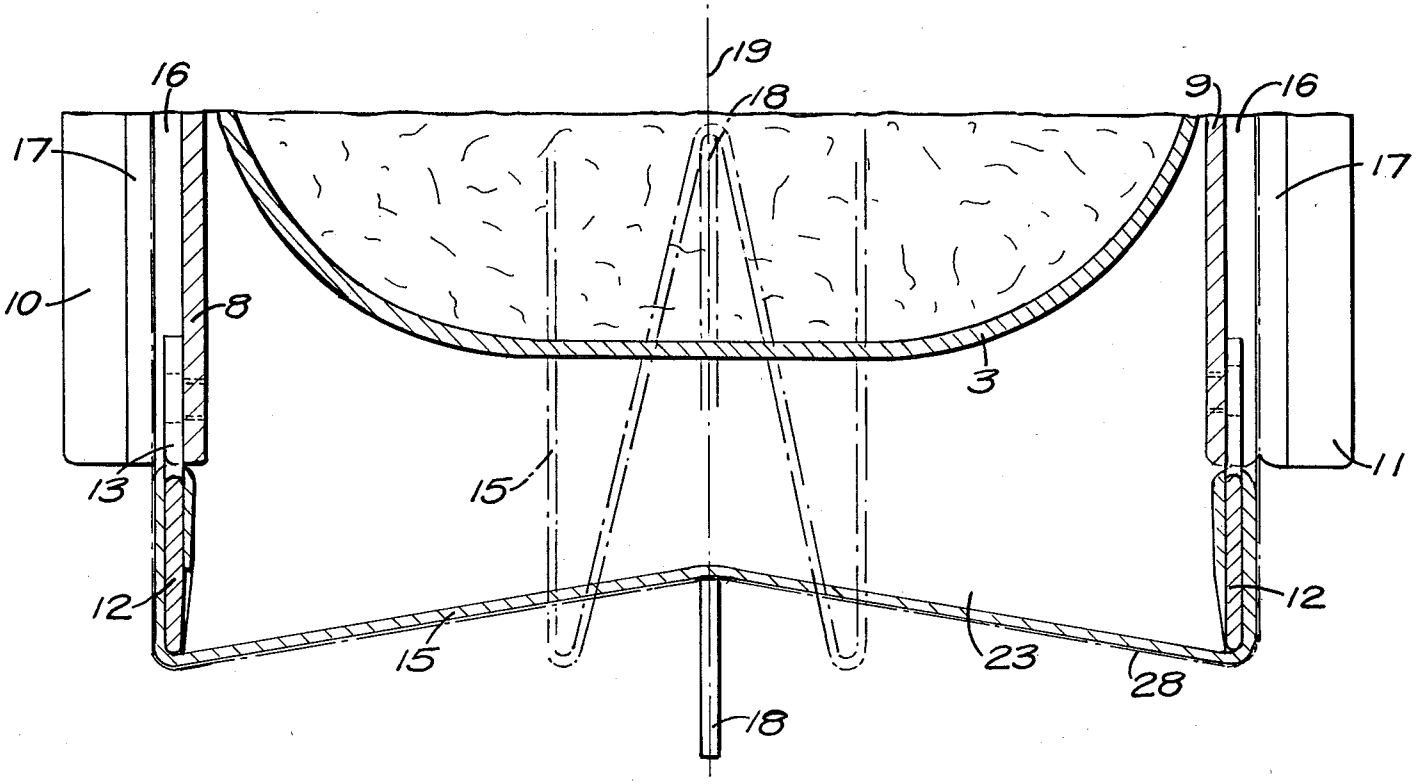
FIG. 5 is a section along line V—V in FIG. 2.

As will be evident from FIG. 5, the outer surface of strip 16 merges with the outer surface of apron 15 in the vicinity of bent sheet 12.

When folding-side sacks are applied to sacking connection 4, a folding device is associated with each of its front sides. The folding device has a folding piece 18 that is movably mounted in the vicinity of the midplane 19 of sacking connection 4 and acts from outside on the applied sack edge 28. The sack edge 28 is represented by the dot-and-dash lines in FIGS. 4 and 5.

Figure 4:
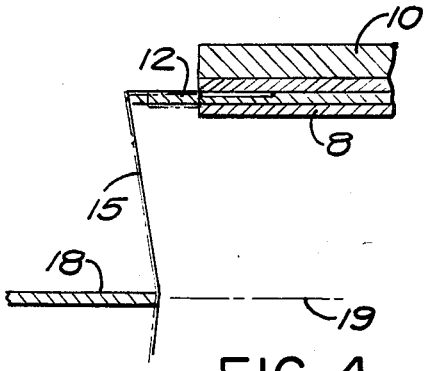
FIG. 4 is a detail of FIG. 3.

Whereas FIG. 4 illustrates sacking connection 4 in the filling position, the phantom lines in FIG. 5 represent the position of apron 15 upon completion of the filling process and once the sacking connection has been closed. In this operating position folding pieces 18 assume their inside limiting position.

Above each folding device is a finger 22 that can be pivoted around an upper horizontal axis 20 and is subjected to the force of a spring 21, its lower end resting non-positively against apron 15 outside in the vicinity of vertical midplane 19.

Fingers 22 tension aprons 15 pre-folded and taut against the inside of sacking connection 4.

Figure 2:
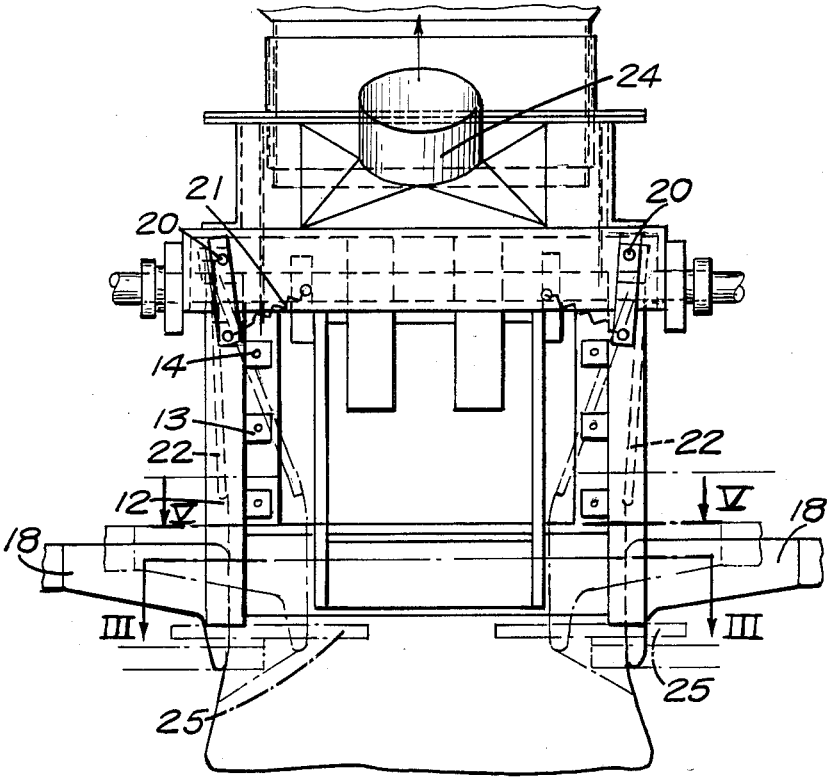
FIG. 2 is a view of the sacking connection from the direction indicated by arrow II in FIG. 1.
Figure 3:
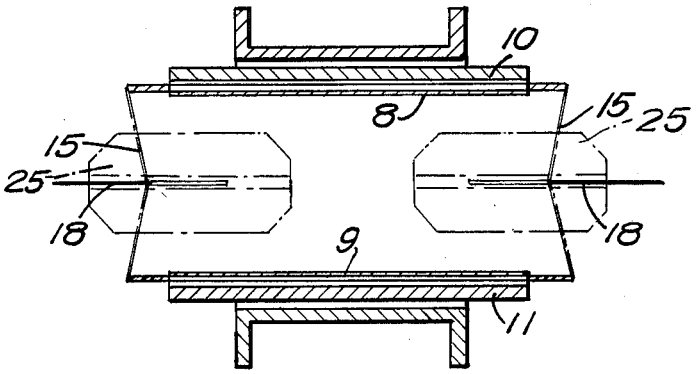
FIG. 3 is a section along line III—III in FIG. 2.

When sacking connection 4 is closed, the resilient fingers 22 assume the position represented in FIG. 2 by the broken lines. Aprons 15 are drawn in around bent sheets 12 and folded in at the bottom of spreading flaps 8 and 9, which are slightly opened, like a side fold.

In this embodiment sacking connection 4 is lowered into the opened edge of the sack with spreading flaps 8 and 9 closed and clamping jaws 10 and 11 open. When the sacking connection is opened, the edge of the sack is forced against clamping jaws 10 and 11 by spreading flaps 8 and 9 and the lateral aprons 15 are slightly tightened outward against the edge of the sack. This tightening of aprons 15 against the edge of the sack is reinforced by the bent sheets 12 completely tightening out the opened side folds inwardly. The edge of the sack is accordingly protected from the action of dust over its full extent.

The sack is filled with the dusty product from product reservoir 1 through loading hose 3. The air entrained by the product can escape into outside areas 23 between loading hose 3 and lateral aprons 15. The air or its dust-laden constituents can be suctioned out of areas 23 by means of a suction device 24 positioned above the horizontal pivoting axes 6 and 7 of spreading flaps 8 and 9.

While sacking connection 4 is being closed, the full sack remains clamped against spreading flaps 8 and 9 with the side folds folded in against the tension of lateral aprons 15 by folding pieces 18. The edge of the sack is accordingly protected from the action of dust over its full extent until sacking connection 4 is closed. The edge of the sack is then, in the closed position and while still clamped tight, grasped immediately below sacking connection 4 by grippers 25 before clamping jaws 10 and 11 are moved back into the opening position and the sacking connection pivoted upwardly.

The vertical range of movement of sacking connection 4 is represented in FIG. 1 by the marks representing its limiting positions.

The grippers 25 in this embodiment are, when the full sack is removed, displaced in synchronization with removal belt 26, which is equipped with trough-shaped sections 27 for positive accommodation of the base of the sacks 5 and which conveys them to a closing station.

As will be evident from FIG. 2, folding pieces 18 extent to some extend down out of sacking connection 4 when it is closed and grippers 25 grasp the edges of the sacks in the vicinity of these projecting parts. The grippers must accordingly have recesses appropriate to accommodate these parts.

Grippers 25 and removal belt 26 can also be positioned for removal to the side of sacking connection 4, in which case the closing equipment is also correspondingly positioned.

When flat sacks are to be applied to sacking connection 4, folding pieces 18 are dismounted and the mechanisms that drive the folding devices are equipped with U-shaped spreading fingers, so that the folding devices are transformed into spreading devices.

The U-shaped spreading fingers exhibit a component that extends down from an upper web, engages the rear of the apron, and extends into the vicinity of the edge of the opening of the sack. The spreading fingers force aprons 15 against the edge of the opening of the sack to produce a non-positive connection between the aprons and the edge of the opening in the vicinity of the lateral aprons as well once the edge of the opening of the sack has been clamped tight in the vicinity of the spreading flaps.

Aprons 15 extend over or almost over the total height of the spreading flaps.

Referring now to FIGS. 6–12, another embodiment is illustrated wherein the same elements have the same elements have the same labels as in FIGS. 1–5 and wherein a pouring funnel, not illustrated, with an outlet connection, also not illustrated, has a flexible loading hose 3 of rubber or a rubber-like plastic at its bottom edge and extending far enough inside a sacking connection 4 to the extent that its bottom edge 5 is below the edge of the opening of a sack clamped to the sacking connection 4.

Sacking connection 4 has two spreading flaps 8, 9 that can be pivoted around horizontal axes 6, 7 and with which are associated clamping jaws 10, 11, which can also be pivoted around horizontal axes 6, 7. The spreading flaps are plates with bent sheets 12 are fastened to their vertical lateral edges. Each plate and each sheet fastened to it is as wide as the sack.

In this embodiment also, bent sheets 12 are provided with screwing flanges 13 that are secured to spreading flaps 8, 9 with screws 14.

To obtain unobjectionable dustproofing in the vicinity of the connecting seam between bent sheets 12 and spreading flaps 8 and 9 the edge parts of an apron 15, made out of rubber or a rubber-like plastic overlap two mutually opposed bent sheets 12 in the vicinity of the connecting seam in the shape of a U. The apron is provided with perforations for the screwing flanges 13 of bent sheets 12 in the vicinity of the connecting seam.

Also in this embodiment, aprons 15 constitute the front sides of sacking connection 4.

Spreading flaps 8 and 9 have strips 16 of rubber or plastic that extend over their bottom horizontal outer edge. The clamping jaws 10 and 11 associated with spreading flaps 8 and 9 have strips 17 of rubber or plastic so that the upper edge of the sack is clamped fast between strips 16 and 17 in the vicinity of the flaps and jaws. The outer surface of strip 16 merges with the outer surface of apron 15 in the vicinity of bent sheet 12. There is a folding device and a spreading device on each front side of sacking connection 4. Each folding device consists essentially of a folding rod 30 that is rigidly connected to a holder 32 that is fixed on a shaft 31. Holder 32 also supports a spreading finger 33 that extends into the top of a sack 29. Apron 15 is located in the gap between folding rod 30 and spreading fingers 33. The edge of the opening of the sack surrounds the bottom of apron 15 with the upper edge of the sack below the bottom of folding rod 30.

Figure 11:
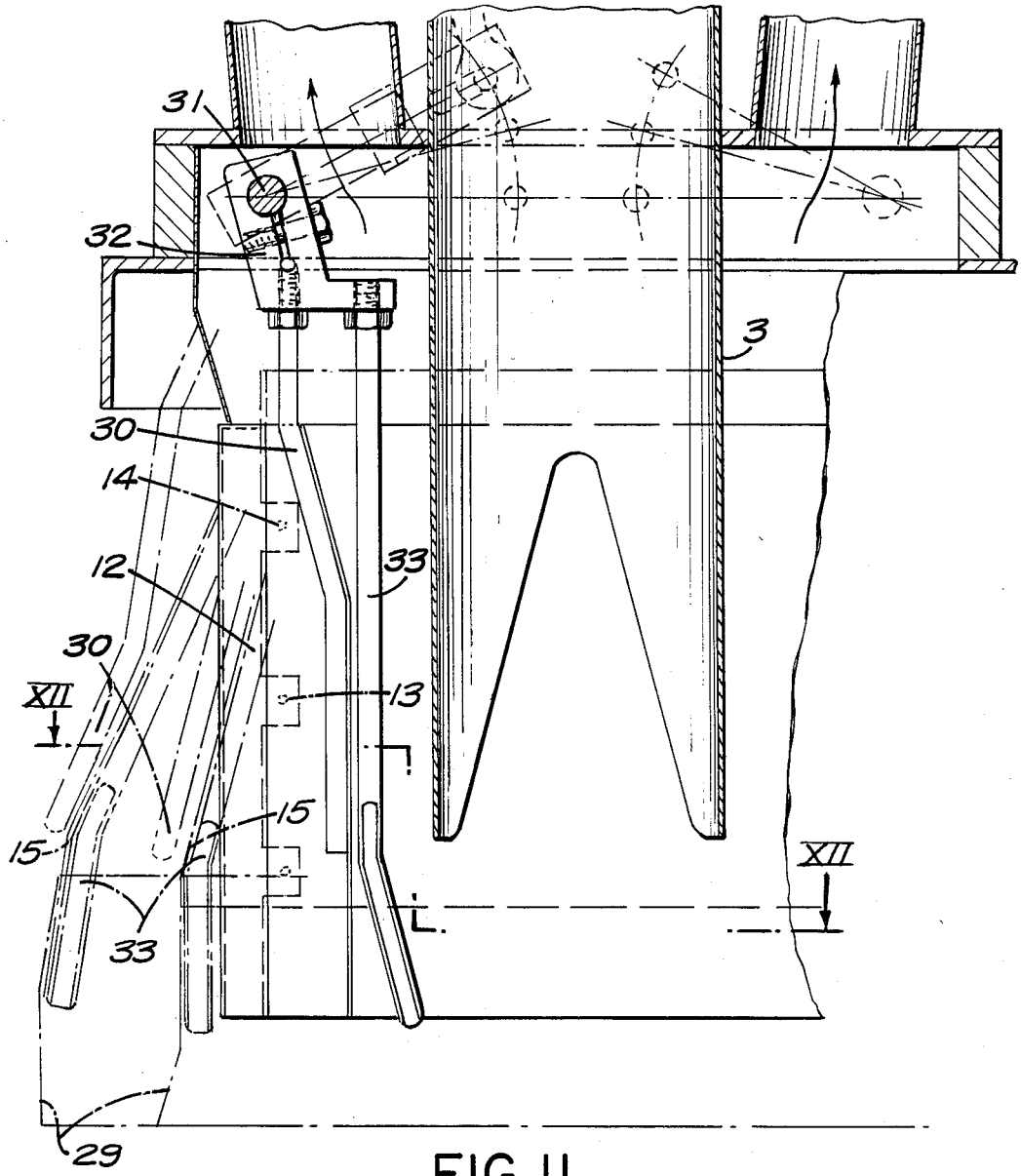
FIG. 11 is a detail of FIG. 9.

A lever 34 is clamped to each shaft 31. The free end of lever 34 is freely articulated to the piston rod 35 of a piston-and-cylinder unit 36. As will be evident from FIG. 9 and 11, piston-and-cylinder unit 36 can pivot both folding rod 30 and spreading fingers 33 from a right-hand limiting position into a left-hand limiting position. FIG. 11 also illustrates a midposition. When folding rod 30 and spreading finger 33 are in the right-hand limiting position, spreading flaps 8 and 9 are closed or slightly open. When they are in the left-hand limiting position spreading flaps 8 and 9 are open to allow the sack to be filled. The open position of the spreading flaps is labeled 8′, 9′ in FIG. 12 and that of the clamping jaws 10′ and 11′. As will be especially evident from FIG. 12, when spreading fingers 33 have been displaced into the left-hand limiting position, they force apron 15 non-positively against the inside of the sack in the vicinity of its upper edge to produce a sealing effect. The edge of the opening of the sack is accordingly effectively protected from the effects of dust during the filling process so that the closure seam can be applied without cleaning the edge.

Figure 12:
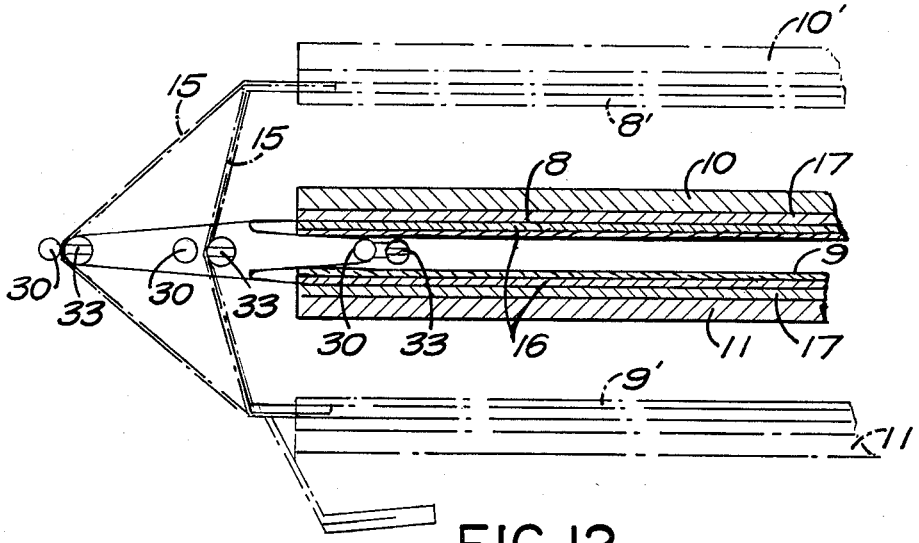
FIG. 12 is a section along line XII—XII in FIG. 11.

As will be especially evident from FIG. 12, pivoting spreading finger 33 transforms apron 15 out of a side-fold shape into a flat shape while spreading flaps 8 and 9 are opening. When spreading flaps 8 and 9 are closed after the sack is full, piston-and-cylinder unit 36 will restore folding rod 30 and spreading fingers 33 to the right-hand limiting position. Folding rod 30, which acts on the outside of apron 15, simultaneously transforms it back into its original side-fold shape.

The sack is filled with the dusty product through loading hose 3. The air entrained by the product can escape through outside areas 23 between loading hose 3 and lateral aprons 15. The air or its dust-laden constituents can be suctioned out of areas 23 by means of a suction device 24 positioned above horizontal pivoting axes 6 and 7 and consisting essentially of tubes 37 and 38. As will be evident from FIG. 8, tubes 37 and 38 are positioned diagonally opposite each other.

Figure 6:
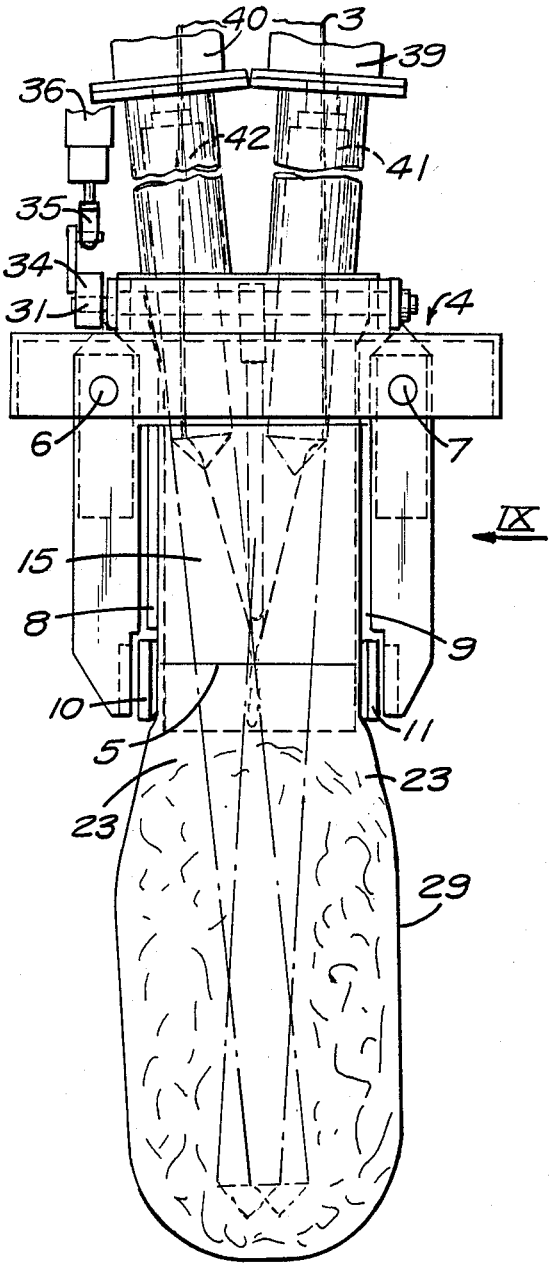
FIG. 6 is a front elevation of a sacking connection with a sack applied in the opening position in accordance with a second embodiment of the invention.
Figure 7:
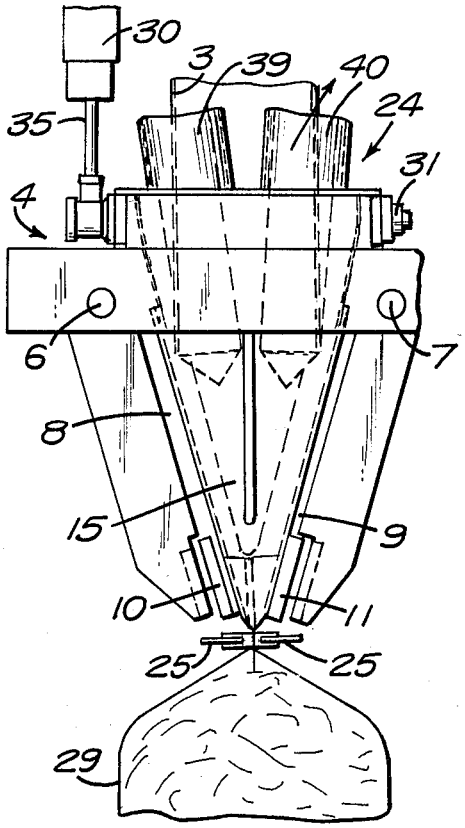
FIG. 7 is a front elevation of the sacking connection of FIG. 6 with the full sack in the closure position.
Figure 8:
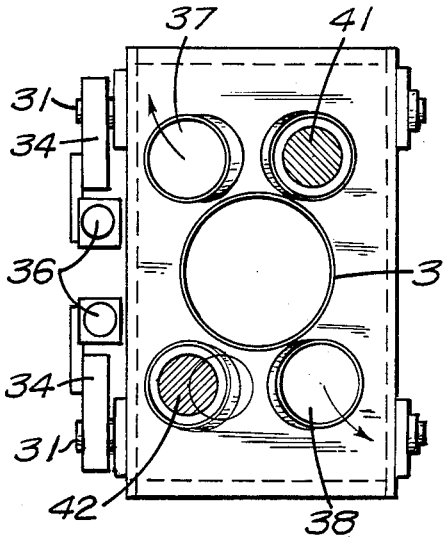
FIG. 8 is a top view in partial section of the state illustrated in FIG. 7.
Figure 9:
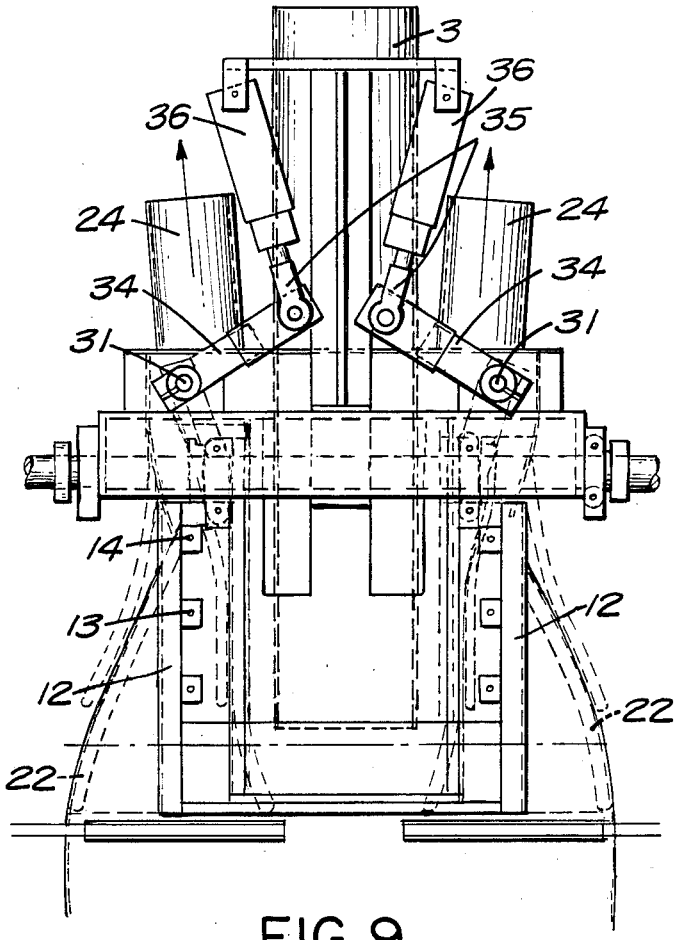
FIG. 9 is a view of the sacking connection from the direction indicated by arrow IX in FIG. 6, showing however, the spreading device in both the rest and the operating positions.
Figure 10:
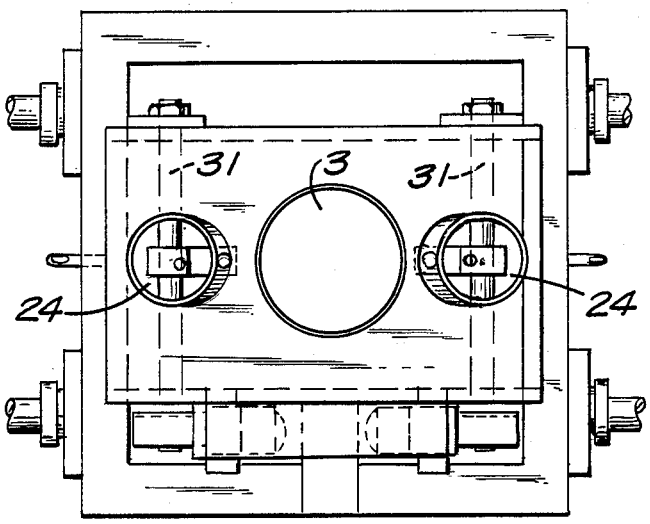
FIG. 10 is a top view corresponding to FIG. 9.

Two receiving tubes 39 and 40 are positioned, also diagonally opposite each other, at the top of sacking connection 4. Each receiving tube 39 and 40 bears an interior pneumatic vibrator 41 or 42. Receiving tubes 39 and 40, and hence interior pneumatic vibrators 41 and 42 as well, can be lowered in a way that is not illustrated to the bottom of sack 29 while it is being filled. The lower position of interior pneumatic vibrators 41 and 42 is represented by the dot-and-dash lines in FIG. 6. Receiving tubes 39 and 40 can also have suction probes instead of interior pneumatic vibrators 41 and 42. As illustrated in FIGS. 6 and 7, when interior pneumatic vibrators 41 and 42 are not in operation they extend partly into the closed sacking connection.

While sacking connection 4 is being closed, the full sack remains clamped against spreading flaps 8 and 9 with the aprons being reshaped by the action of folding rods 30. The edge of the sack is accordingly protected from the action of dust over its full extent until sacking connection 4 is closed. The edge of the sack is then, in the closed position and while still clamped tight, grasped immediately below sacking connection 4 by grippers 25 before clamping jaws 10 and 11 are moved back into the opening position and the sacking connection advanced into the upper position. The full sack is subsequently removed by a removal belt that is not illustrated to the closing station.

It will be appreciated that the instant specification and claims are set forth by way of illustration and not limitation, and that various modifications and changes may be made without departing from the spirit and scope of the present invention.

What is claimed is:

1. In a sacking connection for filling open top sacks with dusty products, having two spreading flaps pivotable around horizontal axes and associated clamping jaws pivotable around horizontal axes and to hold the edge of the opening of the sack against the spreading flaps, the improvement wherein: the spreading flaps comprise plates and bent sheets of metal removably fastened in alignment with the plates to the vertical lateral edges thereof and wherein the plates and bent sheets are as wide as the sacks; dustproof aprons composed of a flexible material fastened in the vicinity of the side edges of the flaps and connecting the spreading flaps together to form the ridges of the sacking connection, wherein the outside of each apron merges at the outside of the bent sheet with a strip of elastic material that extends over the lower horizontal edge of the plate and against which the edge of the opening of the sack can be held with one clamping jaw; folding means associated with each apron and displaceable inwardly from outside the sacking connection to maintain the edges of a side folding sack in direct abuttment with the aprons; and spreading means displaceable outwardly from the inside the sacking connection to maintain the edges of a flat sack in direct abuttment with the aprons.

2. The sacking connection as in claim 1, wherein each apron is U-shaped and overlaps the bent sheet in the vicinity of the connecting seam between the bent sheet and the plate and wherein the bent sheet has screwing flanges that extend through perforations in each apron.

3. The sacking connection as in claim 1, wherein the folding means comprises a folding piece composed of sheet metal, that is movably mounted in the vicinity of the midplane of the sacking connection, that acts from outside on the applied sack edge, that assumes an inner limiting position upon completion of the filling process, and that extends to some extent down out of sacking connection when it is closed.

4. The sacking connection as in claim 3, wherein the folding means further comprises a finger pivotable around an upper horizontal axis and subjected to the force of a spring with its lower end resting against the outside of the apron in the vicinity of the vertical midplane.

5. The sacking connection as in claim 1, wherein the spreading means comprises a U-shaped spreading finger with a vertical component that extends down from an upper web, engages the rear of the apron, and extends into the vicinity of the edge of the opening of the sack.

6. The sacking connection as in claim 1, wherein the aprons extend over the total height of the spreading flaps.

7. The sacking connection as in claim 1, wherein the aprons are composed of rubber or a rubber-like plastic.

8. The sacking connection as in claim 1, further comprising a flexible loading hose fastened to an outlet connection of a pouring funnel, and a suction device for the air escaping from the product into the space between the loading hose and the aprons and for dust positioned above the horizontal pivoting axes of the spreading flaps.

9. The sacking connection according to claim 1 wherein the spreading means comprises two spreading fingers projecting into the sack with their lower ends and positioned in the vertical midplane of the sacking connection and mounting the fingers for rotating around horizontal axes to pivot outward out of the vicinity of the spreading flaps and clamping jaws with a concomitant elastic deformation of the aprons until the aprons rest against the edge of the opening of the sack.

10. The sacking connection as in claim 8, further comprising two folding fingers which rest against the aprons on the outside and mounted for rotating around a common horizontal axis with the spreading fingers.

11. The sacking connection as in claim 10, wherein the horizontal axis is in a driven shaft on which is clamped a holder to which the upper ends of the spreading and folding fingers are attached.

12. The sacking connection as in claim 9, further comprising a central filling tube and an upper framework-like cover through which the filling tube extends, suctioning tubes positioned at one side of the filling tube and suctioning dust from above out of a filling opening that is sealed on all sides.

13. The sacking connection as in claim 9, further comprising receiving tubes on the sacking connection with interior pneumatic vibrators extending partly into the closed sacking connection.

14. The sacking connection as in claim 13, further comprising means mounting the interior pneumatic vibrators for movement into and out of a sack.

* * * * *